US009772119B2

(12) United States Patent
Shellenberger et al.

(10) Patent No.: US 9,772,119 B2
(45) Date of Patent: Sep. 26, 2017

(54) FUEL-FIRED HEATING APPLIANCE HAVING IMPROVED BURNER ASSEMBLY

(71) Applicant: Rheem Manufacturing Company, Atlanta, GA (US)

(72) Inventors: Timothy J. Shellenberger, Tyrone, GA (US); Amin Akbarimonfared, Clifton Park, NY (US); Trent E. Thompson, Roland, OK (US); Darryl J. Farley, Fort Smith, AR (US); Nathan T. Whalen, Alma, AR (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 357 days.

(21) Appl. No.: 14/453,126

(22) Filed: Aug. 6, 2014

(65) Prior Publication Data

US 2016/0040905 A1 Feb. 11, 2016

(51) Int. Cl.

| | |
|---|---|
| ***F24H 3/08*** | (2006.01) |
| ***F23D 14/02*** | (2006.01) |
| ***F23D 14/70*** | (2006.01) |
| ***F24H 9/18*** | (2006.01) |
| ***F23C 3/00*** | (2006.01) |
| ***F23D 14/62*** | (2006.01) |

(52) U.S. Cl.

CPC ..... *F24H 3/087* (2013.01); *F23C 3/002* (2013.01); *F23D 14/02* (2013.01); *F23D 14/62* (2013.01); *F23D 14/70* (2013.01); *F24H 9/1881* (2013.01); *F23D 2203/102* (2013.01); *F23D 2203/105* (2013.01); *F23D 2203/1017* (2013.01)

(58) Field of Classification Search

CPC ..... F24H 3/087; F24H 9/1881; F23D 14/02; F23D 14/70; F23D 14/14

See application file for complete search history.

(56) References Cited

U.S. PATENT DOCUMENTS

| | | | | |
|---|---|---|---|---|
| 2013/0213378 | A1 | 8/2013 | Schultz | |
| 2013/0213379 | A1 | 8/2013 | Schultz et al. | |
| 2015/0369495 | A1 * | 12/2015 | Maricic | F23D 14/045 126/116 A |

* cited by examiner

*Primary Examiner* — Alfred Basichas
(74) *Attorney, Agent, or Firm* — King & Spalding LLP

(57) ABSTRACT

A burner assembly for a fuel-fired heating appliance that defines a direction of flow of a fuel and air mixture in a flow path. The burner assembly comprises a plurality burners defined in a unitary mesh structure. Each burner defines at least one peak at a distal end thereof in a direction of flow of a fuel and air mixture. The burner assembly also comprises a diffuser plate having a plurality of perforated areas defined therein and one or more imperforate areas between respective perforated areas of the plurality of perforated areas. The perforated areas respectively correspond to the plurality of burners. The diffuser plate is disposed in a fixed position upstream of the mesh structure so that, when the burner assembly is disposed in the flow path, a respective flow of the fuel and air mixture is directed from each of the plurality of perforated areas to its corresponding burner of the plurality of burners.

18 Claims, 12 Drawing Sheets

FUEL-FIRED HEATING APPLIANCE HAVING IMPROVED BURNER ASSEMBLY

BACKGROUND

The present invention relates generally to fuel-fired heating appliances, such as furnaces and water heaters. More specifically, embodiments of the invention provide an improved burner assembly for a fuel-fired heating appliance.

In fuel-fired heating appliances such as, for example, air heating furnaces, a known firing method is to flow a fuel/air mixture into a burner box containing a burner, which is conventionally an elongated flat or curved single mesh. An associated igniter is also disposed in the burner box and is operative to combust the fuel/air mixture, thereby creating hot combustion gases used to heat air (or another fluid as the case may be) for delivery to a location served by the heating appliance. Typically, the furnace includes a series of heat exchanger combustor tubes, externally across which the fluid to be heated is flowed. Spaced apart open inlet portions of these combustor tubes extend through corresponding openings in a wall of the burner box which faces the burner, and thus the hot combustion gases are flowed through the combustor tubes. The hot combustion gases are discharged from the heating appliance into a suitable flue structure. At the same time, a blower portion of the furnace forces air being recirculated to and from a conditioned space served by the furnace externally over the heat exchanger combustor tubes to transfer combustion heat therefrom and thereby heat the recirculating air.

In this regard, FIG. 1 is a schematic cross-sectional view of a portion of a combustion section 10 of a prior art fuel-fired heating appliance. Combustion section 10 includes, from left to right in FIG. 1, a burner box 12, a heat exchanger assembly 14, and a collector box 16, joined together as indicated. As shown, burner box 12 forwardly terminates at a rear wall 18 of heat exchanger assembly 14, and heat exchanger assembly 14 forwardly terminates at a rear wall 20 of collector box 16.

Heat exchanger assembly 14 includes five combustor tubes 22. Combustor tubes 22 extend through the interior of heat exchanger assembly 14 and have open inlet ends 24 supported in corresponding openings in rear wall 18 and open outlet ends supported in corresponding openings in rear wall 20. As can be seen in FIG. 1, the open rear inlet ends 24 of combustor tubes 22 are interdigitated with imperforate sections 28 of rear heat exchange assembly wall 18. An inlet 30 of a draft inducer fan is positioned in collector box 16.

Referring also to FIG. 2, a rectangular, flat metal mesh burner 32 is positioned in burner box 12 in a spaced, facing relationship with the open inlet ends 24 of combustor tubes 22. As is well known, burner 32 provides a flame attachment structure and facilitates controlled combustion in burner box 12. Burner 32 is carried within a suitable frame 34 secured to an interior flange portion 36 of burner box 12. An igniter 38 extends into burner box 12 and is operatively associated with burner 32.

During firing of the heating appliance with which burner 32 is associated, a flow 40 of pre-mixed fuel and air is forwardly drawn through burner box 12 to burner 32. At this point, the flow 32 is caused to combust by igniter 38 to form an elongated reaction flame pattern 42 emanating from the downstream side of burner 32. As shown in FIG. 1, portions of the flame pattern 42 are drawn into combustor tubes 22 and form therein hot combustion gases 44. The balance of the flame pattern 42 is directed against wall 18.

At the same time, air 46 (or another fluid) is suitably flowed externally across combustor tubes 22 to create heated air 48 for delivery to a conditioned space served by the heating appliance. The draft inducer fan draws cooled combustion gases 50 from combustor tube outlet ends 26, through the interior of collector box 16, into inlet 30, and eventually exhausts the cooled combustion gases 50 to a suitable flue.

SUMMARY

The present invention recognizes and addresses various considerations of prior art constructions and methods. According to one aspect, the present invention provides a burner assembly for a fuel-fired heating appliance that defines a direction of flow of a fuel and air mixture in a flow path. The fuel-fired heating appliance includes a heat exchanger assembly, a burner box disposed upstream of and in fluid communication with the heat exchanger assembly, and a mixing box disposed upstream of and in fluid communication with the burner box. The burner assembly comprises a plurality burners defined in a unitary mesh structure. Each of the plurality of burners defines at least one peak at a distal end thereof in the direction of flow of the fuel and air mixture. The burner assembly also comprises a diffuser plate having a plurality of perforated areas defined therein and one or more imperforate areas between respective perforated areas of the plurality of perforated areas. The plurality of perforated areas respectively corresponds to the plurality of burners. The diffuser plate is disposed in a fixed position upstream of the mesh structure so that, when the burner assembly is disposed in the flow path, a respective flow of the fuel and air mixture is directed from each of the plurality of perforated areas to its corresponding burner of the plurality of burners. In preferred embodiments, the burner assembly may reduce or eliminate operating noise in the fuel-fired heating appliance.

According to another aspect, the present invention provides a fuel-fired heating appliance, the fuel-fired heating appliance defining a flow path for a fuel and air mixture that defines a direction of flow. The fuel-fired heating appliance comprises a heat exchanger assembly, a burner box coupled with the heat exchanger assembly, and a mixing box upstream of the burner box. The fuel-fired heating appliance further comprises a burner assembly disposed between the burner box and the mixing box. The burner assembly comprises a plurality of burners defined in a mesh structure, wherein each of the plurality of burners defines at least one peak at a distal end thereof in the direction of flow of the fuel and air mixture. A diffuser plate is disposed in a fixed position with respect to the mesh structure, and a flame carryover portion is between the plurality of burners. The burner assembly permits fluid communication between the mixing box and the burner box only at the burners and the flame carryover portion.

In yet another aspect, the present invention provides a burner assembly for a fuel-fired heating appliance. The fuel-fired heating appliance defines a flow path for a fuel and air mixture moving in a direction of flow. The fuel-fired heating appliance comprises a burner box disposed along the flow path, and a mixing box disposed upstream of and in fluid communication with the burner box. The burner assembly comprises a mesh structure comprising a plurality of spaced-apart burners, one or more flame carryover portions between respective burners of the plurality of burners, and a diffuser plate. The diffuser plate has a plurality of perforated areas defined therein and one or more imperforate area between respective perforated areas of the plurality of perforated areas. Each of the plurality of perforated areas respectively corresponds to the plurality of burners and the one or more flame carryover portions. The diffuser plate is disposed in a fixed position upstream of the mesh structure such that, when the burner assembly is disposed in the flow path, a respective flow of the fuel and air mixture is directed from each of the plurality of perforated areas to a respective one of the plurality of burners and the one or more flame carryover portions.

In a still further aspect, the present invention provides a burner assembly for a fuel-fired heating appliance, the fuel-fired heating appliance defining a flow path for a fuel and air mixture. The burner assembly comprises a sandwich structure and a flame carryover portion defined in the sandwich structure. The sandwich structure comprises a mesh structure defining a plurality of burners therein. The sandwich structure further comprises a diffuser plate in which a plurality of perforated areas are defined and a bracket. The perforated areas are defined in the diffuser plate only in locations upstream of the plurality of burners and the flame carryover portion.

Those skilled in the art will appreciate the scope of the present invention and realize additional aspects thereof after reading the following detailed description of preferred embodiments in association with the accompanying drawing figures.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
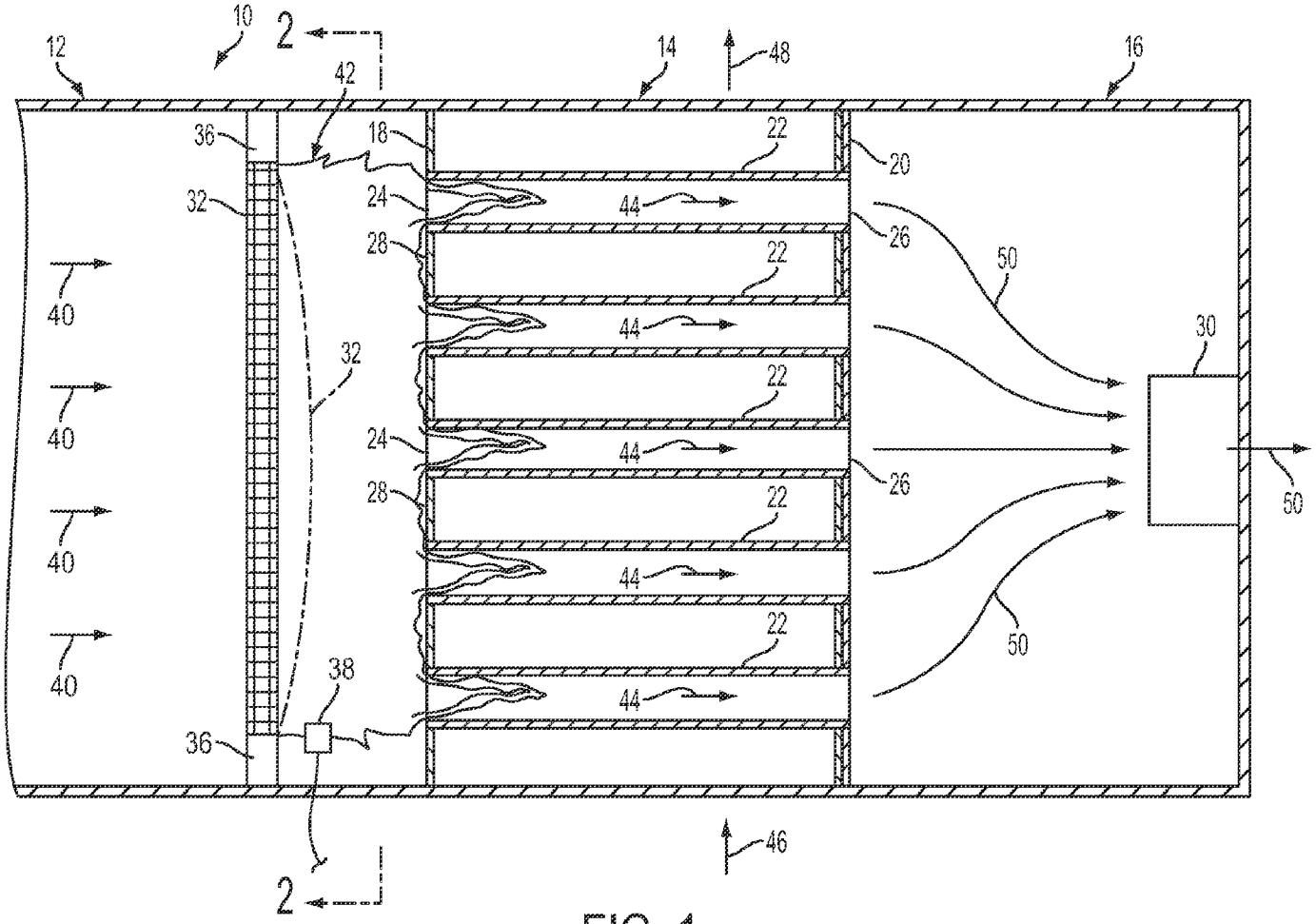
FIG. 1 PRIOR ART
FIG. 1 is a schematic cross-sectional view of a portion of a combustion section of a prior art fuel-fired heating appliance.
Figure 2:
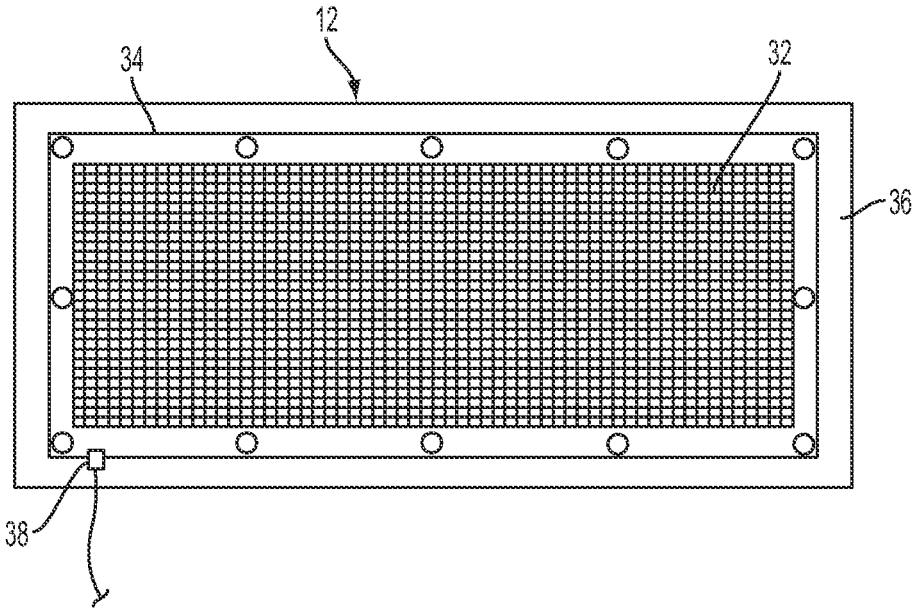
FIG. 2 PRIOR ART
FIG. 2 is a cross-sectional view through the combustion section of FIG. 1 taken along line 2-2.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Some embodiments of the present invention may be particularly suitable for use with a fuel-fired furnace, and the below discussion will describe some preferred embodiments in that context. However, those of skill in the art will understand that the present invention is not so limited. In fact, it is contemplated that embodiments of the present invention may be used with any fuel-fired heat transfer apparatus. For example, embodiments of the present invention may also be used with water heaters, pool heaters, and boilers, among others. Likewise, although some embodiments of the present invention are discussed below with reference to a premixed burner, those of skill in the art will appreciate that other embodiments of the present invention may be used with inshot type burners as well.

Embodiments of the present invention provide an improved burner assembly for a fuel-fired heating appliance. In some embodiments, the burner assembly may comprise a plurality of burners, and a diffuser plate may be disposed adjacent to or abutting the burners, upstream thereof. The plurality of burners may be formed from a unitary mesh structure, and the diffuser plate may define apertures therethrough in locations which correspond to the locations of the plurality of downstream burners. The burners and diffuser plate may be arcuate in cross-section and, in some cases, generally rectangular in shape. In other embodiments, the burner assembly may comprise a sandwich structure wherein the plurality of burners is disposed between the diffuser plate and a support structure. The support structure may be configured to couple the burner assembly with a burner box of a fuel-fired heating appliance, and a mixing box may be coupled with the support structure. Additional details of certain preferred embodiments are discussed below with reference to FIGS. 3-10.

Figure 3:
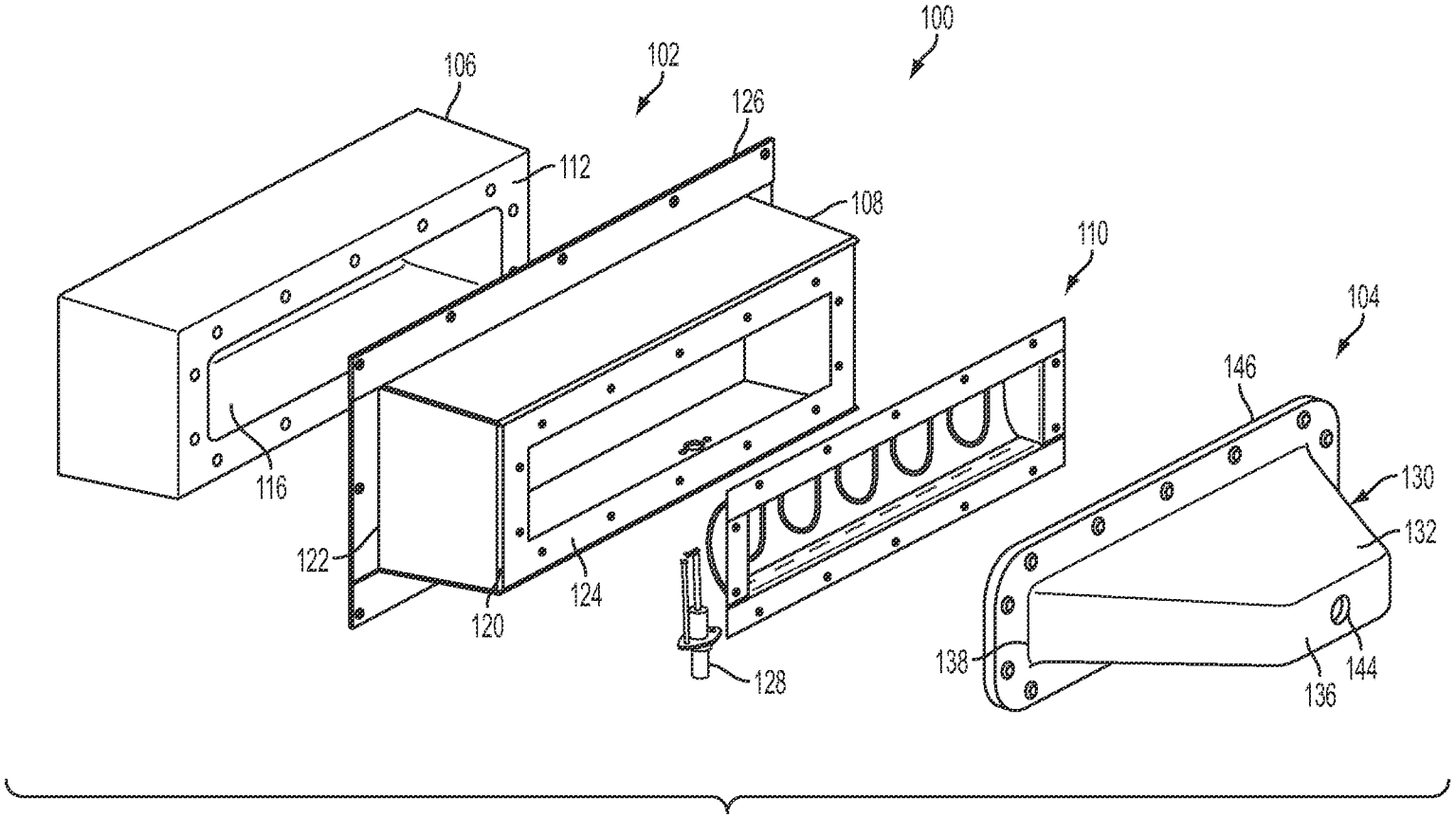
FIG. 3 is an exploded view of a portion of a combustion section of a fuel-fired heating appliance comprising a burner assembly constructed in accordance with an embodiment of the present invention.
Figure 4:
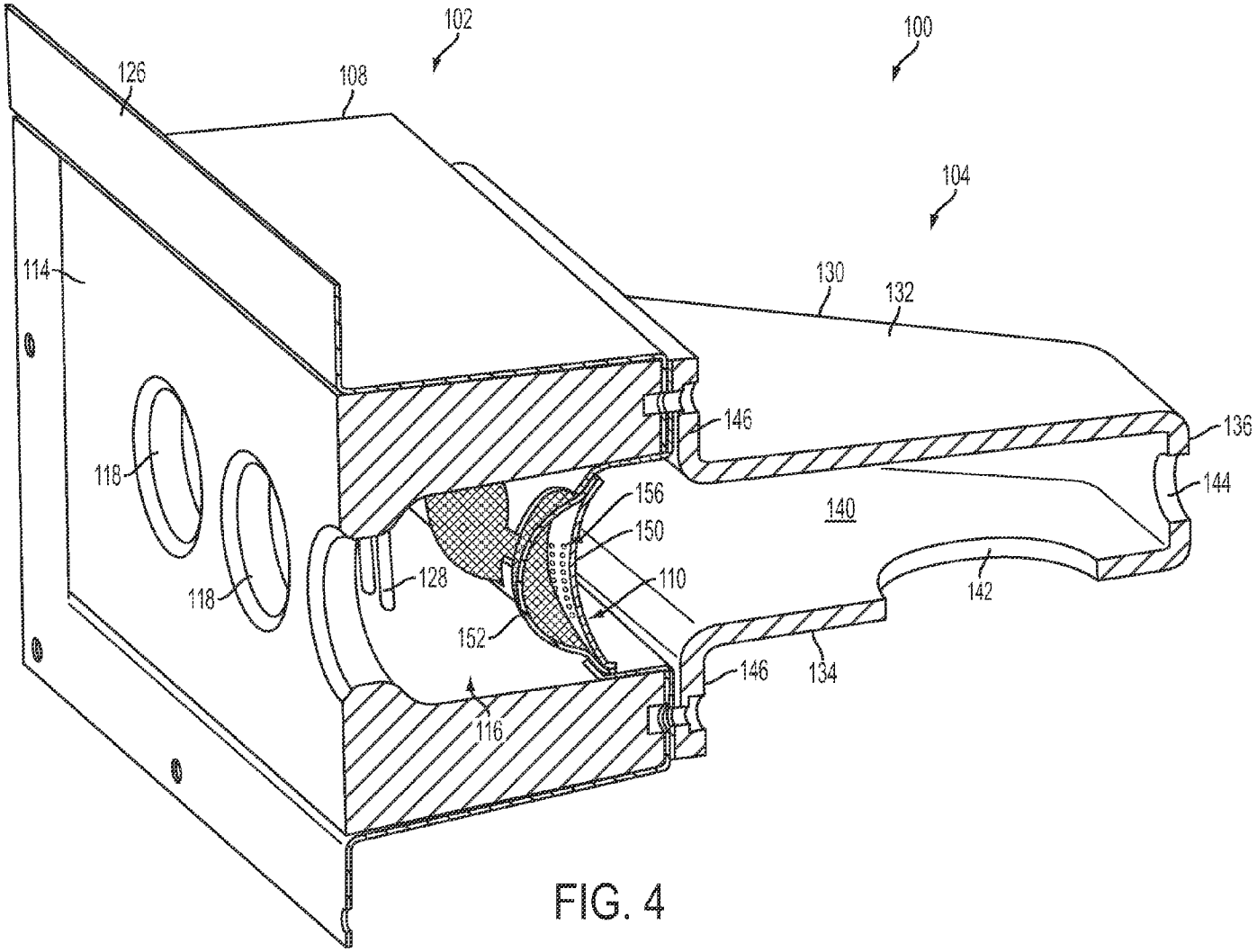
FIG. 4 is a cross-sectional perspective view of the combustion section of FIG. 3.
Figure 5:
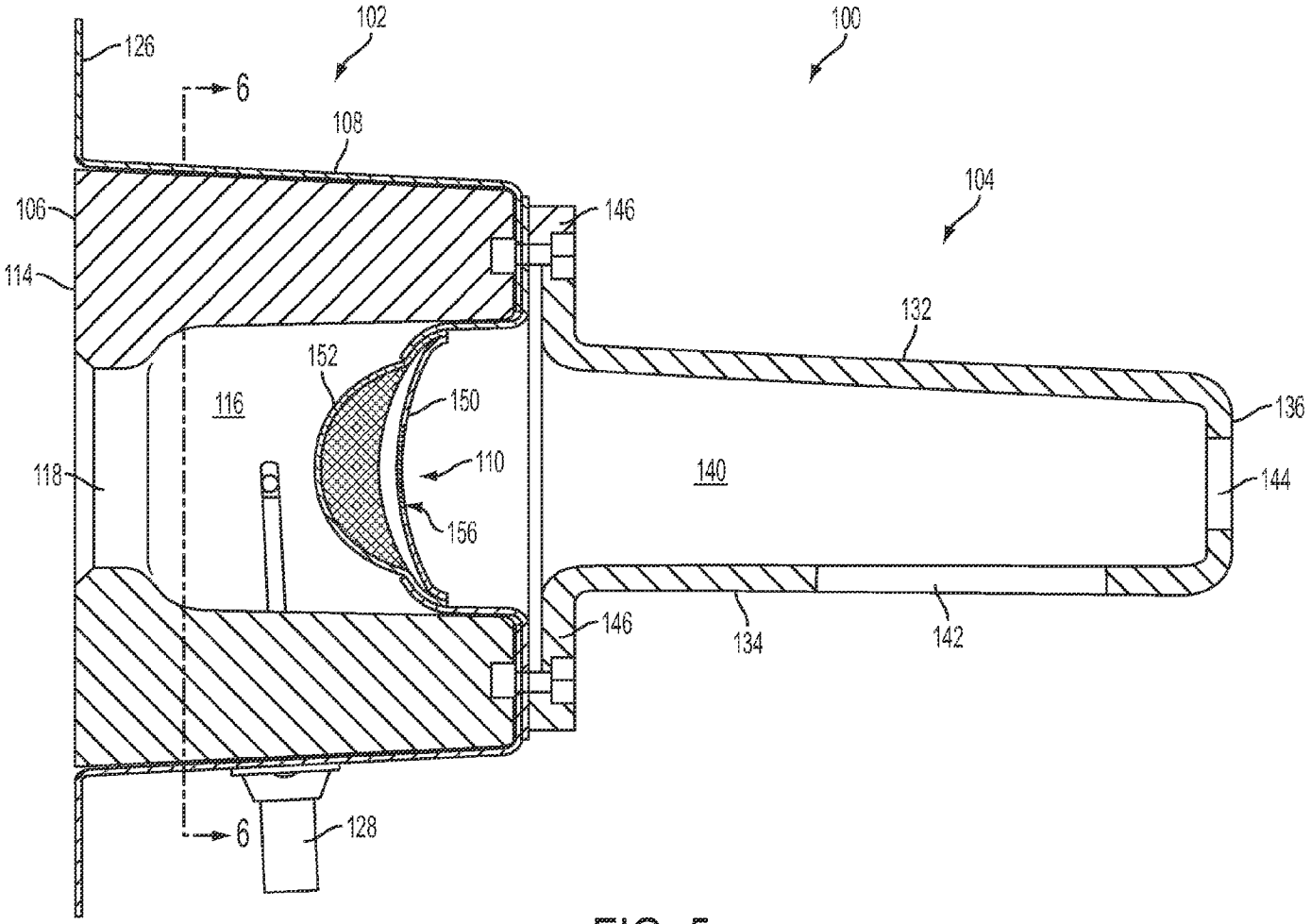
FIG. 5 is cross-sectional right side elevation view of the combustion section of FIG. 3.
Figure 6:
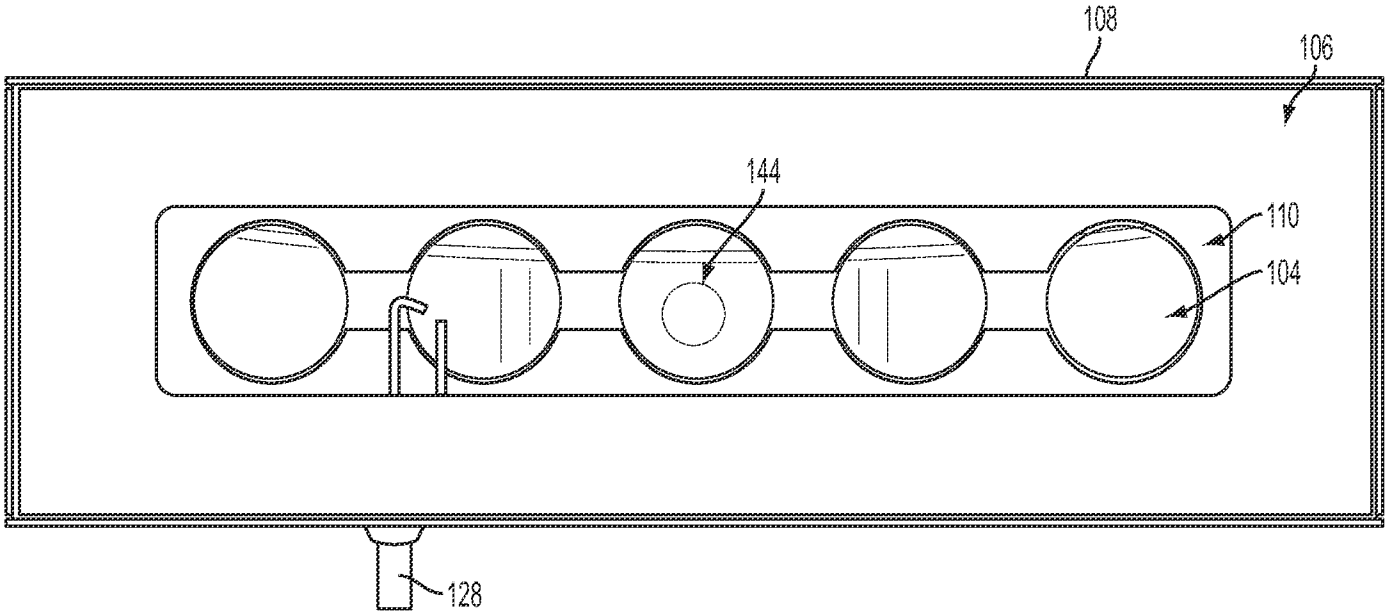
FIG. 6 is a cross-sectional front elevation view of the combustion section of FIG. 3 taken along the line 6-6 in FIG. 5.

FIG. 3 is an exploded view of a portion 100 of a combustion section of a fuel-fired heating appliance comprising a burner assembly constructed in accordance with an embodiment of the present invention. The diffuser plate of the burner assembly, described in greater detail below, is not shown in FIG. 3. FIGS. 4 and 5 are respective cross-sectional perspective and right side elevation views of combustion section portion 100. FIG. 6 is a cross-sectional front elevation view of combustion section portion 100 taken along the line 6-6 in FIG. 5. One example of a fuel-fired heating appliance which may incorporate combustion section portion 100 is an air heating furnace, and certain embodiments are discussed below in that context.

The illustrated portion 100 comprises a burner box 102 downstream of a mixing box 104 and in fluid communication therewith. In general, those of ordinary skill in the art are familiar with the construction of a variety of suitable burner boxes with which embodiments of the present invention may be used. As shown, however, burner box 102 may preferably be configured for engagement with a heat exchanger assembly (see FIG. 12) of the heating appliance, and it may comprise an inner housing portion 106 and an outer housing portion 108. The outer dimensions of inner housing portion 106 are preferably sized such that it may be snugly received within outer housing portion 108 in a telescoping fashion. In other embodiments, however, burner box 102 need not have a two-piece construction. As discussed in more detail below, a burner assembly 110 is secured between burner box 102 and mixing box 104.

More particularly, inner housing portion 106, which may be formed of a refractory material, may define a font surface 112, a back surface 114, and a chamber 116 therein which is open to front surface 112. Back surface 114 preferably defines a plurality of apertures 118 therethrough sized to receive corresponding combustor tubes of the heat exchanger assembly and allow fluid communication between the combustor tubes and chamber 116. In the illustrated embodiment, five such apertures 118 are shown, but it will be appreciated that fewer or more than five apertures 118 may be provided in other embodiments, depending on the configuration of the heat exchanger assembly. Additionally, it will be appreciated that, in other embodiments, apertures 118 may be sized for use with a heat exchanger assembly having a clamshell, rather than tubular, construction (with or without a secondary tube and fin heat exchanger). Outer housing 108, which may be formed of a suitable metal material, preferably resembles a hollow rectangular sleeve defining a leading edge 120 and a trailing edge 122. Further, outer housing 108 preferably defines a flange 124 that projects inwardly along a plane that contains leading edge 120 and a flange 126 that projects outwardly along a plane that contains trailing edge 122.

When inner housing 106 is received in outer housing 108, front surface 112 may abut the back side of flange 124. Flange 124 and front surface 112 preferably define corresponding apertures that align to allow outer and inner housings 108, 106 to be coupled together via suitable fasteners, as described below. In addition, the depth of inner housing 106 may be such that flange 126 is approximately coplanar with back surface 114 when inner housing 106 and outer housing 108 are coupled, as best seen in FIG. 4. Flange 126 may be coupled with the heat exchanger assembly or another structure within the fuel-fired heating appliance via suitable fasteners. Further, an igniter 128, which as shown may be a conventional direct-spark igniter, is preferably coupled with burner box 102 and extends into chamber 116. Although not shown in the figures, a conventional flame sensor and/or a conventional temperature sensor may also be in communication with chamber 116.

As noted above, mixing box 104 may preferably be disposed upstream of burner box 102. In the illustrated embodiment, mixing box 104 may have a relatively thin, trapezoidal housing 130 having top, bottom, and front surfaces 132, 134, 136, respectively, and a trailing edge 138. Also, housing 130 may define a mixing chamber 140 therein. As shown, housing 130 may have a rectangular cross-section the length of which increases as housing 130 extends from rear surface 132 toward trailing edge 138. It will be appreciated that the configuration of the illustrated embodiment of housing 130 may facilitate even distribution of incoming air and fuel across the surface of a burner assembly. The shape of housing 130 may also enhance the quality of the air/fuel mixture, which may in turn reduce $NO_x$ combustion. Although housing 130 is illustrated as trapezoidal in shape, those of skill in the art will appreciate that embodiments of the present invention may be used with mixing boxes of any shape.

Mixing box 104 is preferably configured to facilitate mixing of air and fuel introduced therein upstream of burner assembly 110. Thus, in one embodiment, mixing box 104 may define apertures 142, 144 in bottom and front surfaces 134, 136, respectively. Aperture 142 in bottom surface 134 is preferably configured for fluid communication with a source of fuel, such as natural gas, and for fluid communication with a source of air. In some embodiments, aperture 142 may be provided downstream of a venture structure coupled with a gas injection manifold. Aperture 144 in front surface 136 is preferably configured for receiving a sight glass, or viewport, therein. In some preferred embodiments, however, aperture 144 may not be provided, in which case front surface 136 may be solid. Aperture 142 is preferably sized to facilitate a desired or predetermined fuel/air mixture as air and fuel introduced into mixing chamber 140. The fuel/air mixture is then provided to burner assembly 110 and burner box 102. It will be appreciated that fuel and air entering housing 130 in a direction perpendicular to bottom surface 134 may facilitate mixing. In some embodiments, mixing box 104 may further define one or more structures therein that facilitate the mixing of air and fuel. For example, in one embodiment, mixing box 104 may comprise a mixing structure analogous to that described in commonly-owned U.S. application Ser. No. 14/084,095 (the '095 Application), entitled "Fuel/Air Mixture and Combustion Apparatus and Associated Methods for Use in Fuel-Fired Heating Apparatus," the disclosure of which is incorporated by reference herein in its entirety for all purposes.

Mixing box 104 may also define a flange 146 that projects outwardly along a plane that contains trailing edge 138. The outer dimensions of flange 146 are preferably the same as the outer dimensions of flange 124. Flange 146 may preferably define apertures that align with the apertures defined in flange 124 of outer housing 108 and front surface 112 of inner housing 106. Thus, mixing box 104 and burner box 102 may be coupled together using suitable fasteners. As noted above, burner assembly 110 is preferably coupled between mixing box 104 and burner box 102. In one embodiment, discussed in more detail below, burner assembly 110 may comprise a support structure that defines a flange that engages between flanges 124 and 146 and which is configured to be coupled with mixing box 104 and burner box 102 using the same fasteners.

Figure 7:
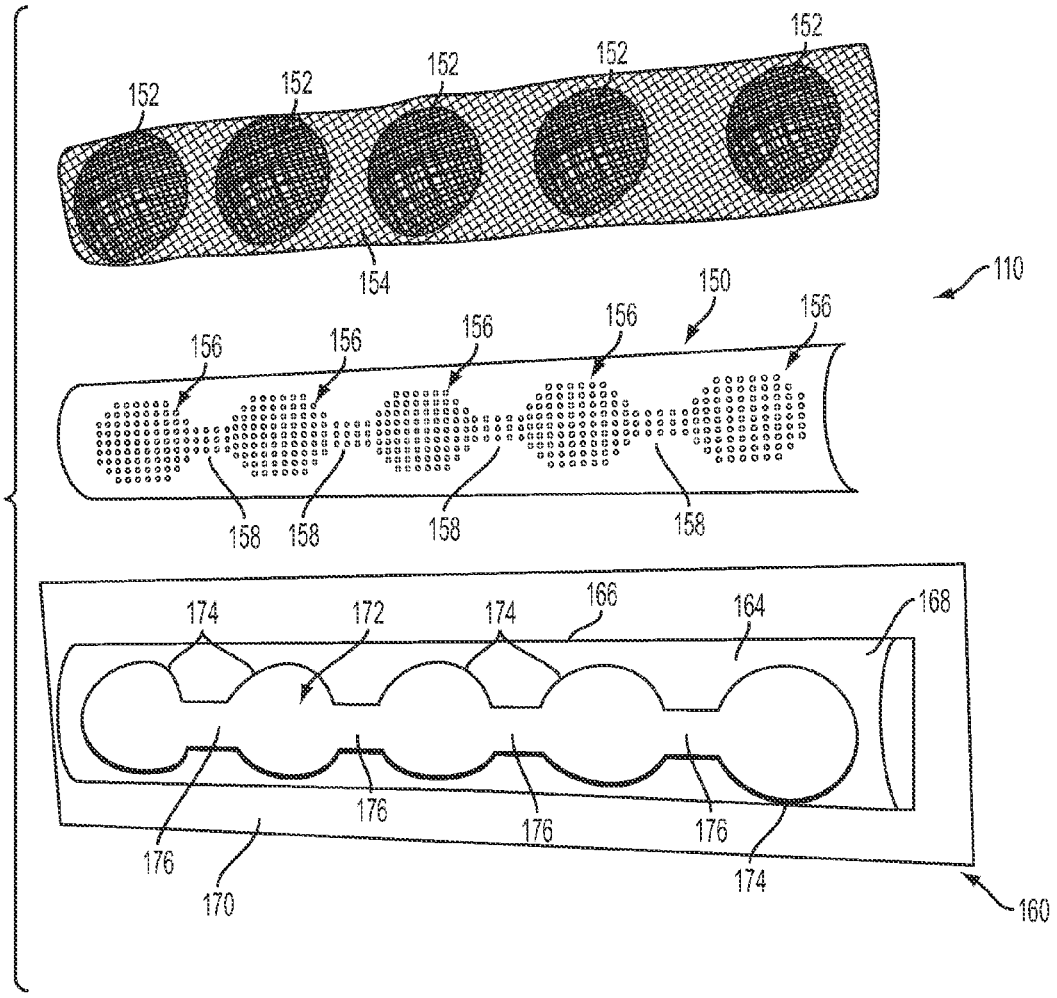
FIG. 7 is an exploded view of a burner assembly constructed in accordance with an embodiment of the present invention.
Figure 8:
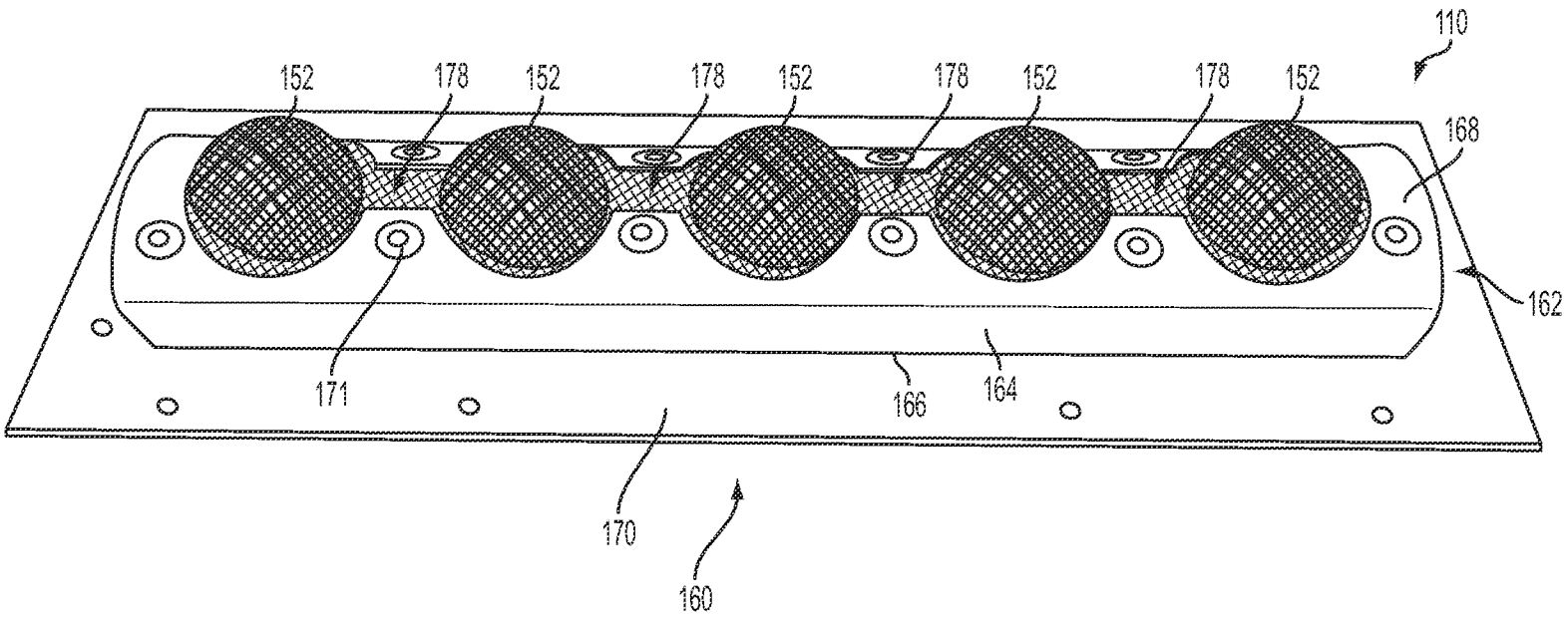
FIG. 8 is a front side perspective view of the burner assembly of FIG. 7.
Figure 9:
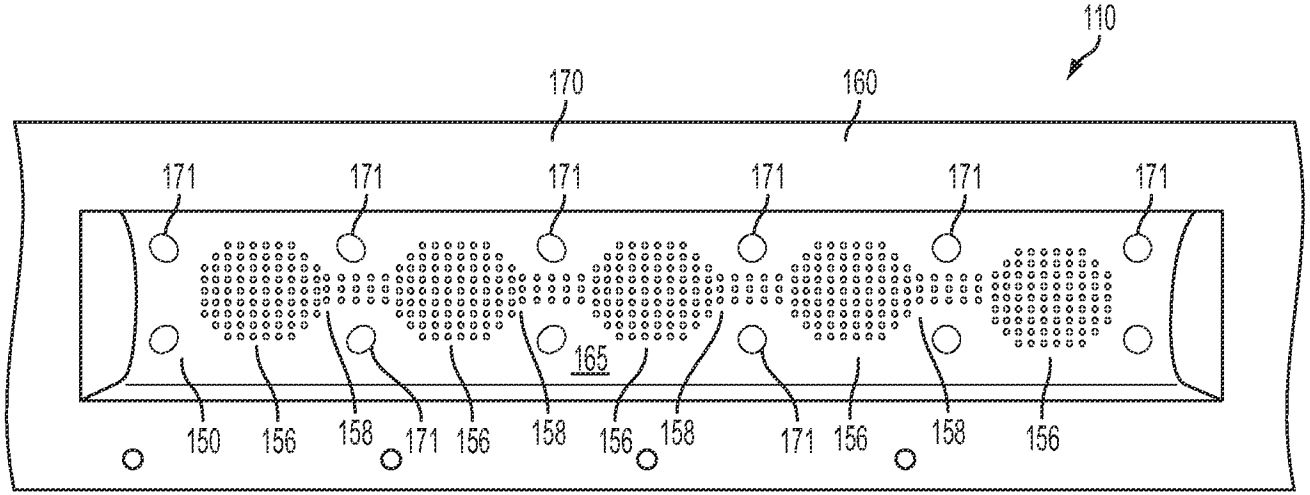
FIG. 9 is a back side perspective view of the burner assembly of FIG. 7.
Figure 10:
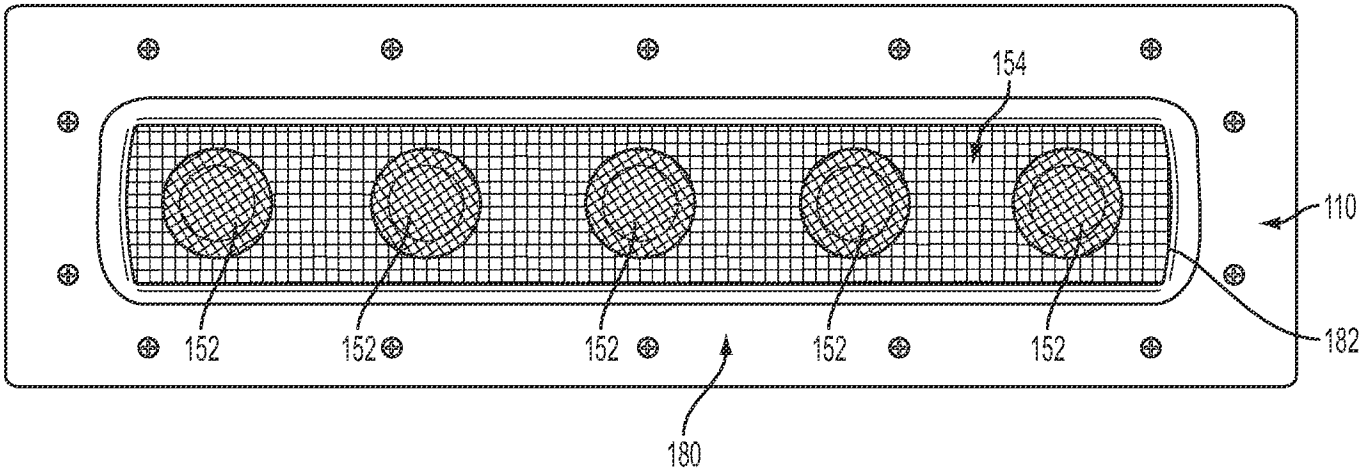
FIG. 10 is a front side elevation view of a burner assembly constructed in accordance with another embodiment of the present invention.

FIGS. 7-10 illustrate embodiments of burner assembly 110 constructed in accordance with embodiments of the present invention. In this regard, FIG. 7 is an exploded view of burner assembly 110, and FIGS. 8-9 are respective front and back side perspective views of burner assembly 110. FIG. 10 is a front side perspective view of a burner assembly constructed in accordance with another embodiment of the present invention.

Turning to the figures, in one embodiment, burner assembly 110 may comprise a diffuser plate 150 and a plurality of burners 152. Notably, burners 152 are preferably defined in a unitary mesh structure 154, for example being stamped or pressed into mesh structure 154 during manufacture. In one embodiment, burners 152 may be formed using a die having balls formed thereon that have a radius which corresponds to the desired radius of burners 152. The die may be pressed into mesh structure 154, which may originally be substantially flat, to form burners 152 therein. Those of skill in the art can select dimensions of burners 152 based on the amount of noise elimination provided in a given system and manufacturing limitations. In any event, in the illustrated embodiment, mesh structure 154 may define five rounded or dome-shaped burners 152 spaced equally along mesh structure 154, which as shown may be substantially rectangular in shape. Each dome defines at least one peak at a distal end thereof in the direction of the fuel flow. In some embodiments, however, each individual burner 152 may define multiple peaks.

In certain embodiments, the number of burners 152 provided and the shape of mesh structure 154 preferably corresponds to the configuration of the heat exchanger assembly with which burner assembly 110 is to be used. Thus, in some embodiments, fewer or more than five burners 152 may be provided. Each burner 152 may be in facing opposition to a corresponding combustor tube of a heat exchanger assembly. Therefore, each burner 152 may be defined in mesh structure 154 in a location that is aligned with a combustor tube of a heat exchanger assembly when mesh structure 154 is coupled with burner box 102.

Notably, the use of dome-shaped burners 152, as opposed to flat, circular burners, has a number of advantages in certain embodiments. For example, dome-shaped burners 152 may reduce operating noise in a fuel-fired heating appliance. In particular, due to their hollow, forwardly-projecting configurations, burners 152 may be substantially more dimensionally stable during firing than the conventional flat burner shown in FIG. 1, which tends to bow forward to its dotted line position and create undesirable noise. Also, the forwardly-projecting configuration of burners 152 may provide a favorable path for thermal expansion, in contrast with prior art flat burners as noted above.

Moreover, in burners used in prior art fuel-fired heating appliances, the combustion reaction occurs on a flat, or even, surface. Because the characteristic frequency of the heat release rate may be a function of the shape at which the heat is released, the heat release rate of each burner is more likely to have the same characteristic frequency at a flat burner surface. This increases a likelihood that combustion reactions at various locations on the burner surface may become "synched" or "coupled" such that they resonate together, which creates an irritating audible sound. Likewise, this coupling may translate into resonance of the burner structure itself, for example at a modal frequency thereof, which can contribute to the operational noise. In contrast, with burners 152, the combustion reactions occur on rounded, or uneven, surfaces. The uneven surface facilitates locally different combustion characteristics at each burner, which makes it less likely that the combustion reactions will become synched or coupled in a way that they resonate together to cause undesirable operating noise as described herein.

Thus, operational noise is substantially reduced, and in some embodiments may be entirely eliminated, with embodiments of the present invention. While the present disclosure presents examples of burners in a domed shape, it should be understood that the shape can vary, for example in a geometry that causes a variation in heat release rate across the burner surface that precludes resonance in air pressure, burner structure, and/or other physical characteristics of the device that can cause an undesirable acoustic response.

Also, as discussed herein, the forwardly-projecting shape of burners 152 may both place them closer to the combustor tubes of a heat exchanger assembly and, in the presence of an ignited fuel and air mixture, create a spaced series of individual flames that directly enter the combustor tubes. This may reduce the amount of heat lost to undue heating of the walls of burner box 102 and may heat the combustor tubes in a more even fashion. In addition, in embodiments forming burners 152 of unitary mesh structure 154, as opposed to embodiments of the present invention in which burners comprise multiple, discrete mesh structures or other multi-part burner structures, reduces the complexity and expense of manufacture.

The forward projection of burners 152 beyond the rest of mesh structure 154 may increase the total active burner surface beyond that of a corresponding number of flat, circular burners used in place of burners 152. Accordingly, in some embodiments, burners 152 may provide generally the same overall heat flux or heating load of a prior art single, flat mesh burner.

Burners 152 need not be dome-shaped in all embodiments. For example, burners 152 may be flat or may be conical as described in commonly-owned U.S. application Ser. No. 14/148,204, the disclosure of which is incorporated by reference herein in its entirety for all purposes. Likewise, it is not required that mesh structure 154 be unitary in all embodiments, and in some cases more than one mesh structure 154 may be provided.

Those of skill in the art are familiar with suitable materials from which mesh structure 154, and thus burners 152, may be formed. In some embodiments, mesh structure 154 may be formed from an iron-chromium-aluminum (FeCrAl) alloy, such as Kanthal™, Fecralloy™, or the like, designed to withstand the temperatures present in fuel-fired heating appliances. In one preferred embodiment, mesh structure 154 may be formed of a nickel-chromium-based alloy, such as Inconel™. Nonetheless, other suitable metal or ceramic materials may be used. Mesh structure 154 may comprise strands, wires, or fibers, which in some embodiments may have a diameter of approximately 0.009 in., woven or knit into a desired shape.

Diffuser plate 150, which preferably has peripheral dimensions similar to those of mesh structure 154 and may also be substantially rectangular in shape, may be disposed upstream of mesh structure 154 in burner assembly 110. In addition, diffuser plate 150 may preferably define an arcuate or bowed cross-section, as best illustrated in FIGS. 4 and 5. Diffuser plate 150 may be formed of a lightweight metal material, such as sheet steel or aluminum suitable for use in temperatures associated with fuel-fired heating appliances, and thus it may be readily and inexpensively rolled or pressed to have the desired cross-section. In a preferred embodiment, diffuser plate 150 is disposed adjacent to or abutting mesh structure 154 such that mesh structure 154, which may be somewhat pliable, takes on a cross-sectional shape similar to that of diffuser plate 150. Thus, in one embodiment, both diffuser plate 150 and mesh structure 154 are arcuate in cross section and, as discussed in more detail below, are arranged in or at burner box 102 such that they project forwardly into chamber 116 as shown in FIG. 5.

As described below, in embodiments of the present invention diffuser plate 150 facilitates an even flow of fluid (such as an air/fuel mixture) through each burner 152, which may produce a more defined flame pattern at each burner 152, reduce inefficient heating of burner box 102, facilitate mixing of fuel and air, and reduce $NO_x$ emissions. In particular, diffuser plate 150 may define a plurality of apertures 156, or perforations, therethrough. As best seen in FIGS. 7 and 9, in one embodiment, apertures 156 do not cover the entirety of diffuser plate 150. Rather, apertures 156 are provided only in locations that correspond to respective areas behind each burner 152, and, in some embodiments, laterally therebetween as noted below, when diffuser plate 150 is assembled behind mesh structure 154. The area of diffuser plate 150 not covered by apertures 156 may be imperforate.

In other words, the areas of diffuser plate 150 in which apertures 156 are defined may correspond to and align with respective areas defined by the peripheral edges of each burner 152 on mesh structure 154 when mesh structure 154 abuts diffuser plate 150 in the assembled furnace. Diffuser plate 150 is disposed in a fixed position upstream of mesh structure 154 in the assembly such that, when burner assembly 110 is disposed in the flow path between mixing box 104 and burner box 102 in the furnace, a respective flow of fuel and air mixture is directed from each of the areas in which apertures 156 are defined to a respective one of burners 152. In the illustrated embodiment, burners 152 are dome-shaped, covering an area defined by substantially round peripheral edges on mesh structure 154. Accordingly, apertures 156 in diffuser plate 150 are respectively disposed within areas bounded by substantially circular circumferences, each corresponding to the area behind a burner 152 when mesh structure 154 is coupled with diffuser plate 150.

In some embodiments, diffuser plate 150 may also have apertures 158 defined therein. Apertures 158, which cover a smaller area than apertures 156 in the described embodiments, are defined in these embodiments in diffuser plate 150 in relatively thin, lengthwise bands or channels between the areas in which apertures 156 are defined. Thus, apertures 158 may allow the flow of fluid between each burner 152, which may facilitate flame carryover to all burners 152. Moreover, apertures 158 may facilitate a more even flame pattern across burner assembly 110.

Apertures 156, 158 may have equal diameters, as shown in the figures, which in one embodiment may be approximately 0.035". Those of skill in the art can select a suitable diameter for apertures 156, 158, and the number and arrangement of the apertures, based on a variety of factors, such as the desired pressure drop across diffuser plate 150 and operational performance. For example, if apertures 156, 158 are sized too small, this may increase the pressure drop across diffuser plate 150 and, correspondingly, the speed (in revolutions per minute, or RPM) of the motor driving the draft induction fan. If apertures 156, 158 are sized too large, however, the pressure drop across diffuser plate 150 may decrease to a point that inhibits ignition.

In other embodiments, however, for example where suction from a draft inducer fan is greater through some combustor tubes than others, it may be desirable to have apertures 156, 158 having unequal diameters. For example, the apertures may be narrower where the suction is greatest, but increased in diameter in those locations that correspond to lower suction. This may cause an even flow of fluid through the diffuser plate and may further facilitate an even temperature distribution across the combustor tubes of a heat exchanger assembly. Additional background regarding the operation of a diffuser plate in a fuel-fired heating appliance is provided in the incorporated '095 Application.

With diffuser plate 150 disposed upstream of mesh structure 154, fluid may only pass through mesh structure 154 at locations corresponding to burners 152 and, in some embodiments, thin, lengthwise bands between each burner 152. Further, as explained above, burners 152 are preferably defined in mesh structure 154 in locations aligned with corresponding combustor tubes of a heat exchanger assembly. Accordingly, diffuser plate 150 and mesh structure 154 may cooperate to generate a flame pattern comprising a spaced series of individual flames at each burner 152 that are directly aligned with and/or directly enter each combustor tube. As a result, the flame pattern does not extend throughout and unnecessarily heat burner box 102, as compared to the blanketing of wall 18 by the single extended flame pattern 42 generated by conventional flat burner 32 shown in FIG. 1. This feature of embodiments of the present invention reduces the inefficiency caused in the system described with reference to FIG. 1, wherein a substantial portion of the generated combustion heat is transferred to burner box 12 rather than to combustor tubes 22.

Burner assembly 110 may further comprise a support structure 160 in some embodiments. As shown, support structure 160 may be coupled with diffuser plate 150, with mesh structure 154 disposed therebetween, to define a sandwich structure 162. Support structure 160 may comprise an elongate body portion 164 having a front end (FIG. 9) that is open to a cavity 165, a leading edge 166, and a convex back surface 168. A flange 170 extends outward along a plane containing leading edge 166. Like diffuser plate 150, support structure 160 may preferably be formed of a thin metal material, such as sheet steel or aluminum, appropriate for a fuel-fired heating appliance environment.

The interior dimensions of cavity 165 are preferably slightly greater than the peripheral dimensions of diffuser plate 150 and mesh structure 154. As shown, elongate body portion 164 and cavity 165 may be substantially rectangular in shape. The curvature of back surface 168 preferably matches the curvature of diffuser plate 150, such that diffuser plate 150 may be snugly received adjacent the upstream side of back surface 158 with mesh structure 154 therebetween, as best seen in FIGS. 8 and 9. As shown in FIG. 9, diffuser plate 150 (and, consequently, mesh structure 154) may be coupled with support structure 160, for example by welds 171.

As best seen in FIG. 7, back surface 168 may define a cutout 172 generally comprising a plurality of holes 174 connected by intermediate slots 176. In one embodiment, cutout 172 may be formed from a simple manufacturing process, such as stamping or punching. In any event, the dimensions of cutout 172 on back surface 168 preferably correspond to the dimensions of apertures 156 and 158 in diffuser plate 150 when assembled with the diffuser plate in a furnace or other heating appliance. Thus, for example, holes 174 may have peripheral dimensions that are similar to or the same as the peripheral dimensions of apertures 156, and slots 176 may have peripheral dimensions which are similar to or the same as the peripheral dimensions of the areas bounding apertures 158. Likewise, holes 174 may have peripheral dimensions that are similar to or the same as the peripheral dimensions of burners 152. Further, the location of cutout 172 on back surface 168 preferably corresponds to the location of apertures 156, 158 on diffuser plate 150, and the location of holes 174 preferably corresponds to the location of burners 152 on mesh structure 154, in the assembled device.

Thus, when mesh structure 154 is received between diffuser plate 150 and support structure 160, burners 152 may project forwardly through holes 174. Likewise, at slots 176, upstream of which are apertures 158, a portion of mesh structure 154 may be exposed. The cooperation of apertures 158, mesh structure 154, and slots 176 may form flame carryover portions 178. Carryover portions 178 may carry a flame lighted at one burner 152 to an adjacent burner 152.

The configuration of support structure 160 in this embodiment may enhance the desirable flame pattern generated by the cooperation of mesh structure 154 and diffuser plate 150, described above. In particular, back surface 168 and cutout 172 may cooperate to further direct or shape fluid passing through apertures 156, 158, such that the fluid passing into burner box 102 may burn only over burners 152 and carryover portions 178. In other words, because of the configuration of diffuser plate 150, back surface 168, and cutout 172, mixing box 104 is in fluid communication with burner box 102 only at burners 152 and carryover portions 178; diffuser plate 150 and back surface 168 block fluid flow around burners 152 and carryover portions 178. This may create an even flow and well-defined individual flames that are directly aligned with and/or directly enter each combustor tube. As a result, it is also contemplated that diffuser plate 150 may not be required in all embodiments.

Figure 11:
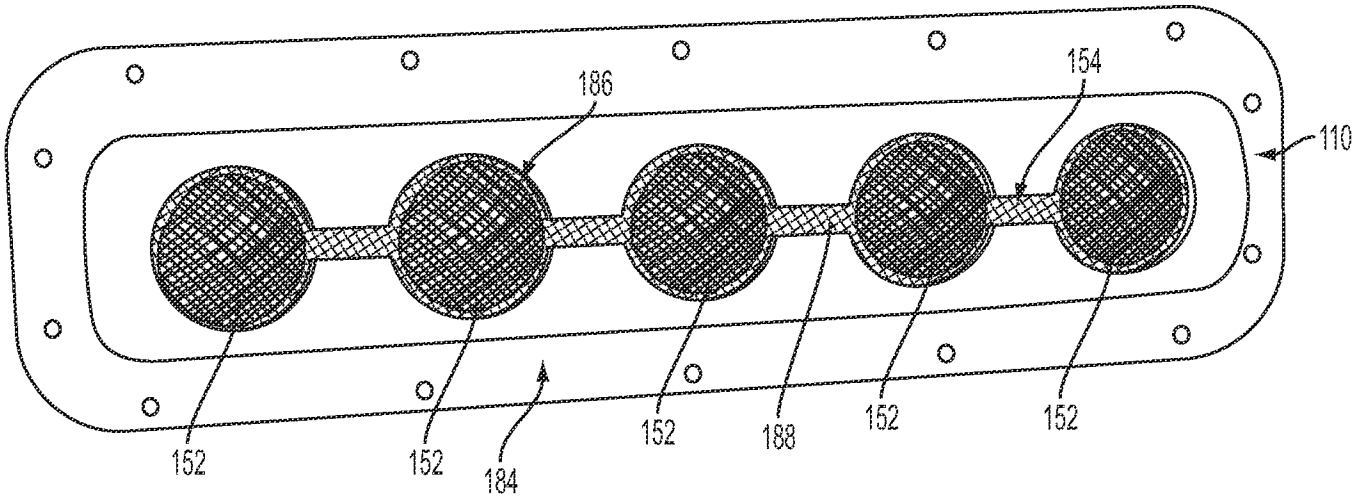
FIG. 11 is a front side perspective view of a burner assembly constructed in accordance with another embodiment of the present invention.

As shown in FIGS. 10 and 11, however, alternative embodiments of burner assembly 110 are contemplated and within the scope of the present invention. In this embodiment, burner assembly 110 may comprise a support structure 180, to which mesh structure 154 and diffuser plate 150 may be coupled in a manner similar to that described above. Support structure 180 differs from support structure 160 in that support structure 180 has a generally open back face 182 rather than cutout 172. Although cutout 172 is not provided in this embodiment, the cooperation of diffuser plate 150, mesh structure 154, and burners 152 facilitates combustion reactions that occur on burners 152. As described above, this may cause different or variable combustion reaction characteristics at each burner 152, which may interrupt synching or coupling of the heat release rate in different locations on mesh structure 154. Again, this may reduce or, in some cases, eliminate, undesirable operating noise.

The embodiment of burner assembly 110 illustrated in FIG. 11 may comprise a support structure 184. Unlike support structure 180 in FIG. 10, support structure 184 may define a cutout 186 in its back surface. Cutout 186 may be generally analogous to cutout 172, described above, but in this embodiment, cutout 186 may comprise slots 188 that are narrower (in the transverse, or shorter, direction at the face of support structure 184) than slots 176, described above. The cooperation of apertures 158, mesh structure 154, and slots 188 may thus form flame carryover portions which are narrower than flame carryover portions 178, also described above. This may be desirable in some embodiments to further reduce or eliminate operational noise. Those of skill in the art can select a suitable width of slots 176 or 178 depending on desired operating characteristics of burner assembly 110, such as the desired flame pattern at each burner 172, the pressure drop across diffuser plate 150, and the amount of operational noise.

In operation of the above-described embodiments, burner assembly 110 is coupled between burner box 102 and mixing box 104, as shown in FIGS. 4-6. In this regard, flange 170 of burner assembly 110 may define apertures that align with the apertures in flange 124 of outer housing 108 and flange 146 of mixing box 104. Thus, mixing box 104, burner assembly 110, and burner box 102 may be coupled together using suitable fasteners at these apertures. When coupled together, elongate body portion 164 of support structure 160 and, correspondingly, mesh structure 154 and diffuser plate 150, may be positioned within chamber 116 of burner box 102, as shown in FIGS. 4 and 5. The curvature of back surface 168, mesh structure 154, and diffuser plate 150 is preferably in a downstream direction of the fluid flow, toward apertures 118. Likewise, dome-shaped burners 152 project forwardly beyond back surface 168 toward apertures 118.

This construction thereby disposes burners 152 in close proximity to apertures 118 of burner box 102, and thus the combustor tubes of the heat exchanger assembly to which burner box 102 may be coupled. Accordingly, the flame patterns produced at burners 152 are more likely to extend directly into the combustor tubes, rather than blanketing the walls of burner box 102. In contrast, if a flat burner were coupled between mixing box 104 and burner box 102, the burner would be disposed farther away from apertures 118 and the associated combustor tubes, which would increase the heat transferred to burner box 102 and, therefore, system inefficiency.

Those of skill in the art will appreciate that a burner assembly constructed in accordance with one or more above-referenced embodiments of the present invention has a number of advantages. First, as explained above, the desirable flame pattern generated by the dome-shaped, multiple burners 152 of burner assembly 110, generally defined by a spaced series of individual flames that are aligned with and/or directly enter the combustor tubes, reduces the heat transferred to the walls of burner box 102 and undue heating of other components within the fuel-fired heating appliance. Correspondingly, a burner assembly according to such one or more embodiments also promotes a more even temperature distribution across combustor tubes of a heat exchanger assembly. Additionally, the construction and forward placement of burner assembly 110—with its sandwich structure 162 of arcuate cross-section that projects forwardly into chamber 116, close to apertures 118 and the combustor tubes of a heat exchanger assembly—only enhances these effects. The arcuate cross-section of sandwich structure 162 may also reduce or eliminate the operating noise caused by the dimensional instability of prior art flat, single burners.

Forming a sandwich structure 162 with diffuser plate 150 may also increase the strength of burner assembly 110. In particular, diffuser plate 150 is itself strong, having apertures 156, 158 defined only in certain predefined areas, rather than over its entire surface. Further, diffuser plate 150 lends strength to the mesh structure 154 and support structure 160 by being coupled therewith, rather than being spaced apart therefrom.

Figure 12:
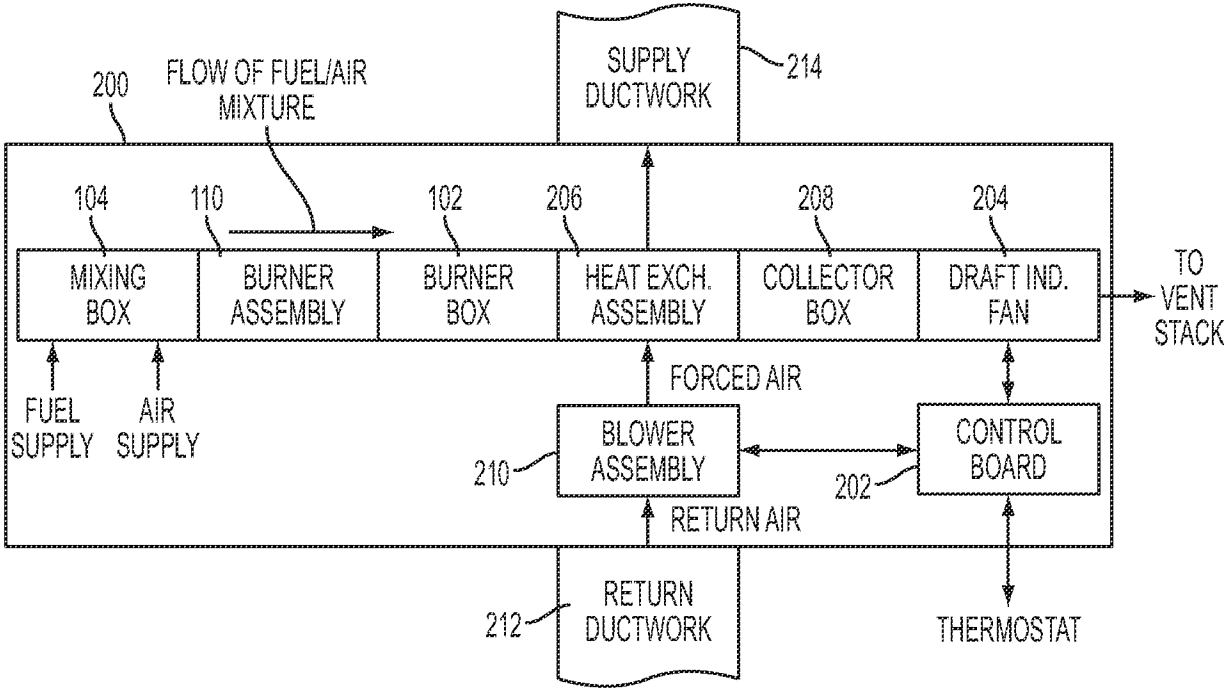
FIG. 12 is a schematic representation of a fuel-fired heating appliance comprising a burner assembly constructed in accordance with an embodiment of the present invention.

FIG. 12 is a schematic representation of a fuel-fired heating appliance 200 comprising burner assembly 110 in accordance with an embodiment of the present invention. Those of skill in the art should be familiar with the operation of a fuel-fired heating appliance as indicated at 200, which as shown may be a forced-air furnace. In general, however, upon a demand for heat from the furnace by a thermostat located in the space to be heated and in electronic communication with a control board assembly 202 of the furnace, control board assembly 202 actuates the burners of burner assembly 110 and a draft inducer fan 204. Specifically, the control board assembly actuates inducer fan 204 via suitable relays and electrical network so that inducer fan 204 draws air and fuel into mixing box 104 to form therein a fuel/air mixture. The fuel/air mixture flows through the burners in burner assembly 110 into burner box 102, where the mixture is ignited by an igniter, such as igniter 128 described above, actuated by control board assembly 202 through a conventional electrical connection. The air flow directs flames and resulting combustion gases from the burners are directed into the open inlet ends of combustor tubes in a heat exchanger assembly 206. As noted above, the combustor tubes are preferably coupled with apertures 118 of burner box 102. In any event, the air flow draws the combustion gases through heat exchanger assembly 206 by the operation of draft inducer fan 204 and so that the combustion gases may then pass through one or more collector boxes 208 before entering the inlet of draft inducer fan 204. Combustion products entering draft inducer fan 204 are then discharged from the fan into an associated vent stack.

At the same time, a blower assembly 210 of the furnace draws return air from the conditioned space served by the furnace upwardly through return ductwork 212 connected to an opening in the bottom of the furnace housing and into a blower chamber. Air entering the blower chamber enters the inlet of the blower assembly and is forced upwardly across the combustor tubes of heat exchanger assembly 206. As it traverses heat exchanger assembly 206, the air receives combustion heat therefrom. The heated air then exits the furnace housing into supply ductwork 214 for delivery to the conditioned space served by the furnace.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A burner assembly for a fuel-fired heating appliance that defines a direction of flow of a fuel and air mixture in a flow path and that has a heat exchanger assembly, a burner box disposed upstream of and in fluid communication with the heat exchanger assembly, and a mixing box disposed upstream of and in fluid communication with the burner box, the burner assembly comprising:

a plurality of burners defined in a mesh structure, wherein each of the plurality of burners defines at least one peak at a distal end thereof in the direction of flow of the fuel and air mixture;

a diffuser plate having a plurality of perforated areas defined therein, the plurality of perforated areas respectively corresponding to the plurality of burners;

the diffuser plate being disposed in a fixed position upstream of the mesh structure so that when the burner assembly is disposed in the flow path, a respective flow of the fuel and air mixture is directed from each of the plurality of perforated areas to its corresponding burner of the plurality of burners; and a bracket that secures the mesh structure to the burner box, wherein the mesh structure and the diffuser plate are coupled with the bracket, and the bracket has a surface that is arcuate in the direction of flow and through which the plurality of burners extend.

2. The burner assembly of claim 1, wherein the burner assembly is configured to be secured between the mixing box and the burner box.

3. The burner assembly of claim 1, further comprising one or more imperforate areas between respective perforated areas of the plurality of perforated areas.

4. The burner assembly of claim 1, wherein the burner assembly defines at least one flame carryover portion between the plurality of burners.

5. The burner assembly of claim 1, wherein each burner of the plurality of burners defines a surface that is arcuate in the direction of flow and wherein the arcuate surface of the bracket conforms to the arcuate surfaces of the burners.

6. The burner assembly of claim 1, wherein the diffuser plate defines an arcuate cross-section.

7. The burner assembly of claim 1, wherein each of the plurality of perforated areas defines a circular area, and the plurality of perforated areas have substantially equal diameters of the circular areas.

8. The burner assembly of claim 1, wherein each of the plurality of burners is dome-shaped.

9. A fuel-fired heating appliance, the fuel-fired heating appliance defining a flow path for a fuel and air mixture that defines a direction of flow, the fuel-fired heating appliance comprising:

a heat exchanger assembly;

a burner box coupled with the heat exchanger assembly;

a mixing box upstream of the burner box; and a burner assembly disposed between the burner box and the mixing box, the burner assembly comprising:

a plurality of burners defined in a mesh structure, wherein each of the plurality of burners defines at least one peak at a distal end thereof in the direction of flow of the fuel and air mixture;

a diffuser plate disposed in a fixed position with respect to the mesh structure;

a flame carryover portion between the plurality of burners; and a bracket that secures the mesh structure to the burner box, wherein the mesh structure and the diffuser plate are coupled with the bracket, and the bracket has a surface that is arcuate in the direction of flow and through which the plurality of burners extend, wherein the burner assembly permits fluid communication between the mixing box and the burner box only at the burners and the flame carryover portion.

10. The fuel-fired heating appliance of claim 9, wherein the fuel-fired heating appliance is an air heating furnace.

11. The fuel-fired heating appliance of claim 9, wherein each burner of the plurality of burners defines a surface that is arcuate in the direction of flow and wherein the arcuate surface of the bracket conforms to the arcuate surfaces of the burners.

12. The fuel-fired heating appliance of claim 9, wherein the diffuser plate defines an arcuate cross-section.

13. The fuel-fired heating appliance of claim 12, wherein the burner assembly extends into the burner box proximate the heat exchanger assembly.

14. The fuel-fired heating appliance of claim 9, wherein the plurality of burners of the burner assembly are aligned with corresponding combustor tubes in the heat exchanger assembly.

15. A burner assembly for a fuel-fired heating appliance that defines a flow path for a fuel and air mixture moving in a direction of flow and having a burner box disposed along the flow path and a mixing box disposed upstream of and in fluid communication with the burner box, the burner assembly comprising:

a mesh structure comprising a plurality of spaced-apart burners;

one or more flame carryover portions between respective burners of the plurality of burners;

a diffuser plate having a plurality of perforated areas defined therein and one or more imperforate areas between respective perforated areas of the plurality of perforated areas, the plurality of perforated areas respectively corresponding to the plurality of burners and the one or more flame carryover portions; and a bracket that secures the mesh structure to the burner box, wherein the mesh structure and the diffuser plate are coupled with the bracket, and the bracket has a surface that is arcuate in the direction of flow and through which the plurality of burners extend, the diffuser plate being disposed in a fixed position upstream of the mesh structure so that when the burner assembly is disposed in the flow path, a respective flow of the fuel and air mixture is directed from each of the plurality of perforated areas to a respective one of the plurality of burners and the one or more flame carryover portions.

16. The burner assembly of claim 15, wherein each of the plurality of burners defines at least one peak at a distal end thereof in the direction of flow of the fuel and air mixture.

17. The burner assembly of claim 15, wherein each burner of the plurality of burners defines a surface that is arcuate in the direction of flow and wherein the arcuate surface of the bracket conforms to the arcuate surfaces of the burners.

18. A burner assembly for a fuel-fired heating appliance, the fuel-fired heating appliance defining a flow path for a fuel and air mixture, the burner assembly comprising:

a sandwich structure; and a flame carryover portion defined in the sandwich structure; and the sandwich structure comprising:

a mesh structure, the mesh structure defining a plurality of burners therein;

a diffuser plate having a plurality of perforated areas defined therein, and a bracket, wherein the mesh structure and the diffuser plate are coupled with the bracket, and the bracket has a surface that is arcuate in a direction of flow of the fuel and air mixture and through which the plurality of burners extend, wherein the perforated areas are defined in the diffuser plate only in locations upstream of the plurality of burners and the flame carryover portion.

* * * * *